US008646210B2

(12) United States Patent
Mauriac

(10) Patent No.: US 8,646,210 B2
(45) Date of Patent: Feb. 11, 2014

(54) DEVICE FOR ADJUSTING THE ORIENTATION OF A PORTHOLE IN AN OPEN POSITION

(76) Inventor: Pierre Mauriac, Merignac (FR)

( * ) Notice: Subject to any disclaimer, the term of this patent is extended or adjusted under 35 U.S.C. 154(b) by 350 days.

(21) Appl. No.: 12/670,350

(22) PCT Filed: Jul. 21, 2008

(86) PCT No.: PCT/EP2008/059535

§ 371 (c)(1),
(2), (4) Date: Jun. 16, 2010

(87) PCT Pub. No.: WO2009/013272

PCT Pub. Date: Jan. 29, 2009

(65) Prior Publication Data

US 2011/0167733 A1 Jul. 14, 2011

(30) Foreign Application Priority Data

Jul. 24, 2007 (FR) ..... 07 56717

(51) Int. Cl.
*E05D 7/00* (2006.01)

(52) U.S. Cl.
USPC ..... 49/402; 49/400; 49/192; 49/394; 404/25; 114/202; 114/203

(58) Field of Classification Search
USPC ..... 49/402, 400, 401, 394, 149, 192, 193, 49/261, 247; 114/201 R, 202, 203; 404/25; 220/817, 818, 820
See application file for complete search history.

(56) References Cited

U.S. PATENT DOCUMENTS

| | | | | |
|---|---|---|---|---|
| 7,927 | A * | 2/1851 | Goodrich | 114/178 |
| 428,227 | A * | 5/1890 | Preston et al. | 114/178 |
| 1,226,766 | A * | 5/1917 | Gammeter | 220/315 |
| 1,610,766 | A * | 12/1926 | Gildersleeve | 49/247 |
| 3,913,971 | A * | 10/1975 | Green | 296/218 |

(Continued)

FOREIGN PATENT DOCUMENTS

| | | |
|---|---|---|
| DE | 640486 C | 1/1937 |
| FR | 1020180 A | 2/1953 |

(Continued)

OTHER PUBLICATIONS

French Search Report and Written Opinion dated Apr. 4, 2008.

*Primary Examiner* — Katherine Mitchell
*Assistant Examiner* — Marcus Menezes
(74) *Attorney, Agent, or Firm* — Perman & Green, LLP

(57) ABSTRACT

A device for setting the position of a closing element for a porthole in an open position toward the outside around an opening in a wall of a room includes a protruding part with a circular shape fastened to the wall around the opening by means of at least one fastener, and a joining part that has a first end connecting a hinged end of the closing element to the protruding part. The protruding part has at least one first groove. The joining part has a second end movable in the at least one first groove, and the movement of the second end in the at least one first groove entails movement of the closing element in the open position around the opening. In a closed position, the closing element integrally covers the protruding part in order to seal the porthole in the closed position.

11 Claims, 4 Drawing Sheets

(56) References Cited

U.S. PATENT DOCUMENTS

| | | | | |
|---|---|---|---|---|
| 4,996,467 | A * | 2/1991 | Day | 318/480 |
| 5,184,422 | A * | 2/1993 | Wade et al. | 49/239 |
| 6,070,751 | A * | 6/2000 | Mejias | 220/253 |
| 7,011,227 | B2 * | 3/2006 | Ward et al. | 220/254.3 |
| 2005/0244227 | A1 * | 11/2005 | Akkala et al. | 404/25 |
| 2006/0185249 | A1 * | 8/2006 | Whittlesea et al. | 49/402 |

FOREIGN PATENT DOCUMENTS

| | | | |
|---|---|---|---|
| FR | 2613002 | A | 9/1988 |
| GB | 935628 | A | 9/1963 |
| NL | 1016415 | C2 | 4/2002 |

* cited by examiner

DEVICE FOR ADJUSTING THE ORIENTATION OF A PORTHOLE IN AN OPEN POSITION

CROSS-REFERENCE TO RELATED APPLICATIONS

This application is the National Stage of International Application No. PCT/EP2008/059535 International Filing Date, 21 Jul. 2008, which designated the United States of America, and which International Application was published under PCT Article 21 (s) as WO Publication N. WO2009/013272 A1 and which claims priority from, and the benefit of, French Application No. 0756717 filed on 24 Jul. 2007, the disclosures of which are incorporated herein by reference in their entireties.

The aspects of the disclosed embodiments relate to a device that provides for setting the position of a closing element in the position opened toward the outside along the periphery of an opening that has any shape whatsoever made in the wall of a room. The device is particularly suitable for setting the orientation of a porthole in the open position toward the outside.

BACKGROUND

Various systems are known for a porthole opening toward the outside. These opening portholes generally equip a boat, a camper, or any type of roof for a prefabricated room for example. They are generally openings made in the hull of the boat, or for example in the roof of the camper. These openings are equipped with a transparent or opaque element that is to close this opening or to leave this opening partly open to ventilate the room in the boat or in the camper.

In the traditional systems of a porthole, the installation of the transparent or opaque element on the frame of an opening is a fixed installation in which the element, once in position open toward the outside, cannot be moved further, and in particular the inclined surface formed by this element in the open position relative to the wall of the camper or of the boat cannot be further reoriented.

When the element is opened in the direction opposite to the wind direction, the inclined surface formed by the element deflects the wind and consequently does not favor the circulation of air. The element in the open position constitutes a partial shield for the circulation of air and does not allow efficient ventilation of the room equipped with such a porthole. It is essential to be able to optimize the ventilation for a boat or a camper, in particular if the portholes that equip it have a small opening.

Another problem is encountered in the case of traditional vertical portholes when it is necessary to ventilate the room in rainy weather; the porthole in the open position lets the rain come into the room when the element is opened toward the rain.

SUMMARY

To correct these drawbacks, the disclosed embodiments propose integrating a device for setting the orientation of this element when it is the open position toward the outside, more precisely a device that provides for setting the position of the element in the open position around the circumference of the opening. In this way, once the element is in the open position, the user can set its position so as to orient the inclined surface of the element either in the direction of the wind to provide for better ventilation of the room, or in the direction opposite to the rain so as to prevent the rain from entering into the room.

The purpose of the disclosed embodiments accordingly is to propose a device, simple in design and in method of operation, that allows the position of the element in the open position to be set around the circumference of the opening in a single operation.

To this end, the disclosed embodiments relate to a device for setting the position of a closing element for a porthole in the position open toward the outside around the circumference of an opening that has any shape whatsoever made in the wall of a room, said device comprising

- a protruding part with a circular shape fastened to the wall around said opening by means of at least one fastener,
- a joining part that has a first end connecting a hinged end of said element to the protruding part.

According to the disclosed embodiments, said protruding part has at least one groove, this joining part has a second movable end in said at least one groove made on at least a portion of the side wall of the protruding part, and the motion of said second end in the groove entails the motion of the element in the open position around said opening.

"Fastener" means any type of fastening screw for fastening this protruding part on the wall around the opening, with the opening essentially being centered relative to the frame formed by the protruding part.

Depending on the type of room that is to be equipped with the porthole and on the need, the closing element can be composed of a transparent element mounted on a frame or simply an opaque element whose dimensions are fitted to those of the opening.

In various particular embodiments of this setting device, each having particular advantages and being capable of numerous possible technical combinations:

- said protruding part is a monobloc part, said groove being formed by a non-blocking cavity in the form of a U made in the side wall of said protruding part;
- said protruding part is composed of two protruding parts fastened to the inside and outside surface of the wall, respectively, and around the opening, said groove being formed by the side walls of the two parts and intended to receive the second movable end of the joining part, which is T-shaped.

The periphery of the element and the protruding part preferably have at least one groove on their inside surface facing one another, into which is inserted a gasket, so that when the element is in the position called closed, said gasket is compressed between the protruding part and the element, so as to obtain the tightness of the porthole in the closed position. The gasket may be continuous along the inside surface of the element. To guarantee its fastening inside the groove, it is possible to cement it with a resin or to fasten it by means of a screw.

According to the disclosed embodiments, the device has stops that have a rounded projecting section placed along the inside wall of the groove, with said stops interacting with the second end to control and block the motion of the element in the open position along the circumference of said opening by driving in or disengaging the rounded protruding section.

In an embodiment of the disclosed embodiments, the hinged end of the element is mounted in rotation on the first end of the joining part, allowing the element to be moved from a first position called the rest position in which it covers the opening, to a second position called the use position in which the element is in the open position, forming a surface inclined relative to the wall.

In another embodiment of the disclosed embodiments, it has a telescopic arm, one end of which is fastened to the element by means of at least one fastener and another end is mounted in rotation on the first end of the joining part, with said arm being capable of moving the element from a first position called the rest position in which said element covers the opening, to a second position called the use position in which said element is in the open position, forming an inclined surface.

It is advantageous for the device to have a gripping element placed on one end of the inside surface of the closing element, said gripping element on the one hand providing for opening the element, and on the other hand providing for moving the element around the circumference of the opening.

But it is possible to foresee integrating a stepping motor in the joining part, said motor being controlled by remote programmable automation allowing the user to set the ending positions of the element around the circumference of the opening automatically.

The disclosed embodiments likewise relate to a porthole equipped with a device as described above.

BRIEF DESCRIPTION OF THE DRAWINGS

The disclosed embodiments will be described in further detail with reference to the attached drawings, in which.

DETAILED DESCRIPTION

Figure 1:
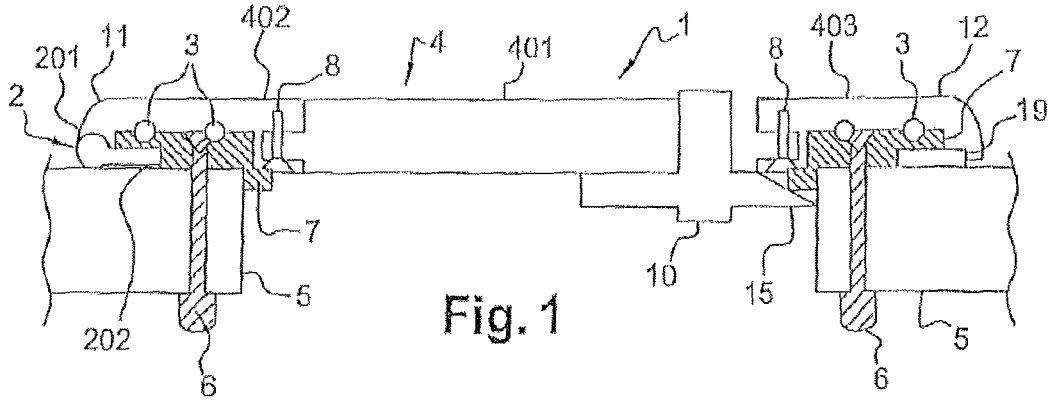
FIG. 1 is a cross sectional view of a device for setting the position of a closing element around an opening according to a first embodiment of the disclosed embodiments, with the said element being in the position called the rest position.

FIG. 1 represents an example of a porthole 1 in the closed position mounted on a side wall 5. The porthole is composed of a closing element 4, which itself is generally composed of a glass part 401 held in a frame 402, 403. This part is joined to the frame by means of a row of rivets 8 extending over the entire periphery of the body of the frame. This closing element 4 with a generally circular shape (FIG. 1A) is intended to cover an opening made in the side wall 5 of a camper or of a boat that has dimensions smaller than those of the element.

This part can also be joined to the frame by mechanical fasteners such as retaining clips so as to be able to change this part easily when it is damaged, without the necessity of completely disassembling the porthole.

In an alternative form of the element 4, it is composed of a single monobloc part.

A protruding part 7 that has a circular shape is joined to the side wall 5 around the opening by means of fasteners 6, such as a fastening screw, over the entire periphery of the opening in the side wall. This protruding part constitutes a frame of the opening on which the element 4 is mounted.

FIG. 1 shows that a first end 11 of this element 4 is connected to the protruding part 7 via a joining part 2. The first end 11 is a hinged end mounted in rotation on an end 201 of the joining part 2 by means of an assembly of the hinge type.

This mounting in rotation allows the element 4 to be moved from a first position called the rest position in which it covers the opening, to a second position called the use position in which the element 4 is in the open position, forming a surface inclined relative to the wall 5.

The joining part 2 has a second end 202 movable in a first groove made on at least a portion of the exterior side wall of the protruding part 7, and the movement of this second end 202 in this groove entails the movement of the element 2 in the open position around the circumference of the opening.

In this way, when the element is in the open position to ventilate a room, for example, the user can set the position of the element around the circumference of the opening by moving it, so as to orient the inclined surface of the element either in the direction of the wind to provide for better ventilation of the room, or in the direction opposite to the rain so as to prevent the rain from entering into the room.

FIG. 1 shows an embodiment of the device for setting the position of the element in which the protruding part is a monobloc part, and the first groove is then formed by a non-blocking cavity 19 that has a U shape on the exterior side wall of the protruding part. This cavity is made in a continuous fashion encircling the protruding part. But it can also be made on a portion of the side wall of this laterally protruding part.

Figure 2:
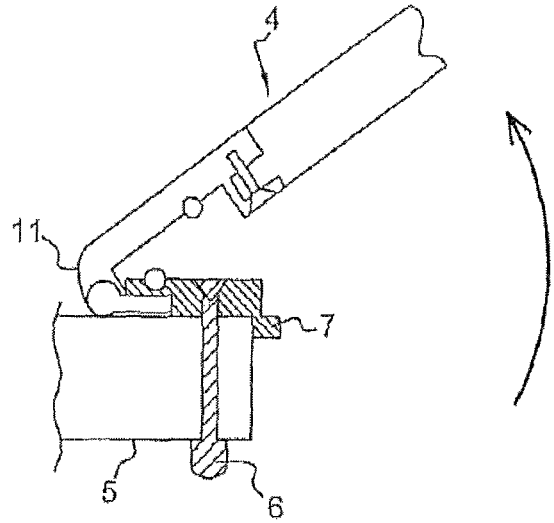
FIG. 2 represents the device of FIG. 1 in the position called the opened position.

First of all, the user unblocks the end 12 of the element 4 by freeing a stop 15 from its groove. This stop is composed here, by way of example, of one end of a gripping element 10. The element is then free to be put into the opened position, forming a surface inclined with respect to the surface of the wall, as shown in FIG. 2. The user slides the second end 202 of the joining part in the cavity to set the position of the element around the circumference of the opening so as to orient the inclined surface of the element in the direction chosen by the user.

To facilitate the opening and the movement of the element, the device for setting the position is provided with the gripping element 10 placed on one end of the internal surface of the element 4.

Alternatively, these actions can be motorized by a standard motor such as a stepping motor, and can be remote-controlled by the user.

Figure 2A:
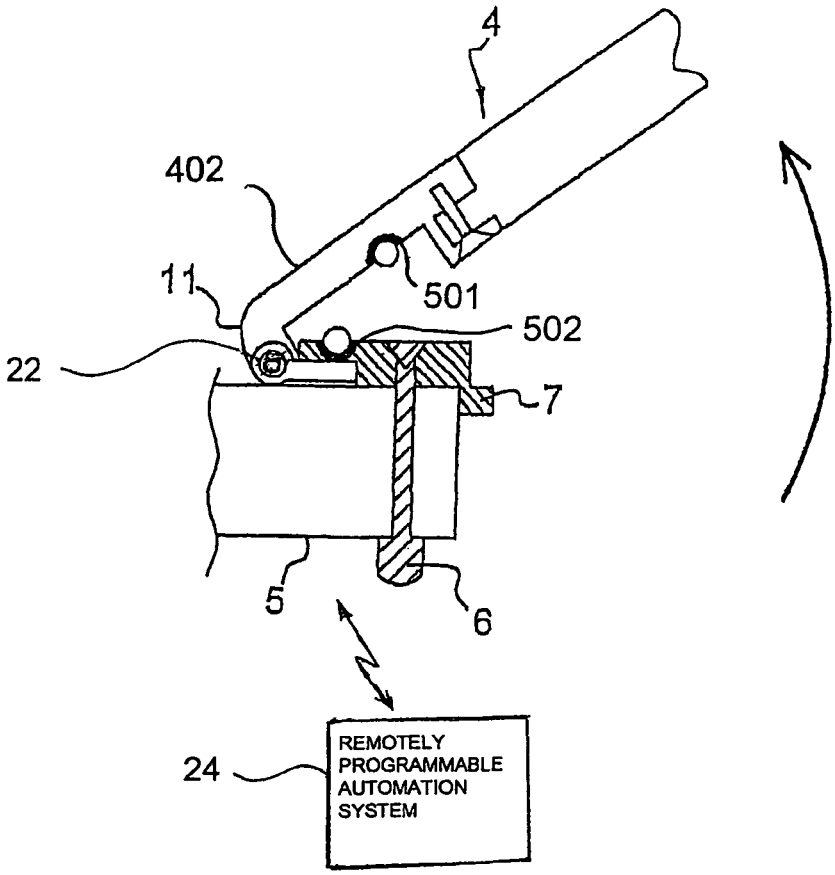
FIG. 2A shows an aspect of the device of FIG. 1.

By way of example as shown in FIG. 2A, a stepping motor 22 can be integrated in the joining part 2, said motor being controlled, for example, by a remotely programmable automation system 24 to set the ending positions of the element 4 around the circumference of the opening.

The internal wall of the groove is advantageously covered by a lining made of a plastic material such as teflon; such a lining provides for reducing the effects of friction of the second end against the walls of the groove, conferring better wear resistance in use and thus avoiding any seizing problems with the setting device.

The periphery 402 of the element 4 and the surface of the protruding part 7 facing the periphery 402 advantageously have second grooves 501, 502 (FIG. 2A) in which are inserted gaskets 3 so that when the element is in the closed position, the sealing of the porthole is obtained by compressing the gaskets between the element 4 and the protruding part 7. This gasket is a continuous gasket extending along the periphery of the opening, which is made, for example, of an elastomer derived from rubber.

Figure 1A:
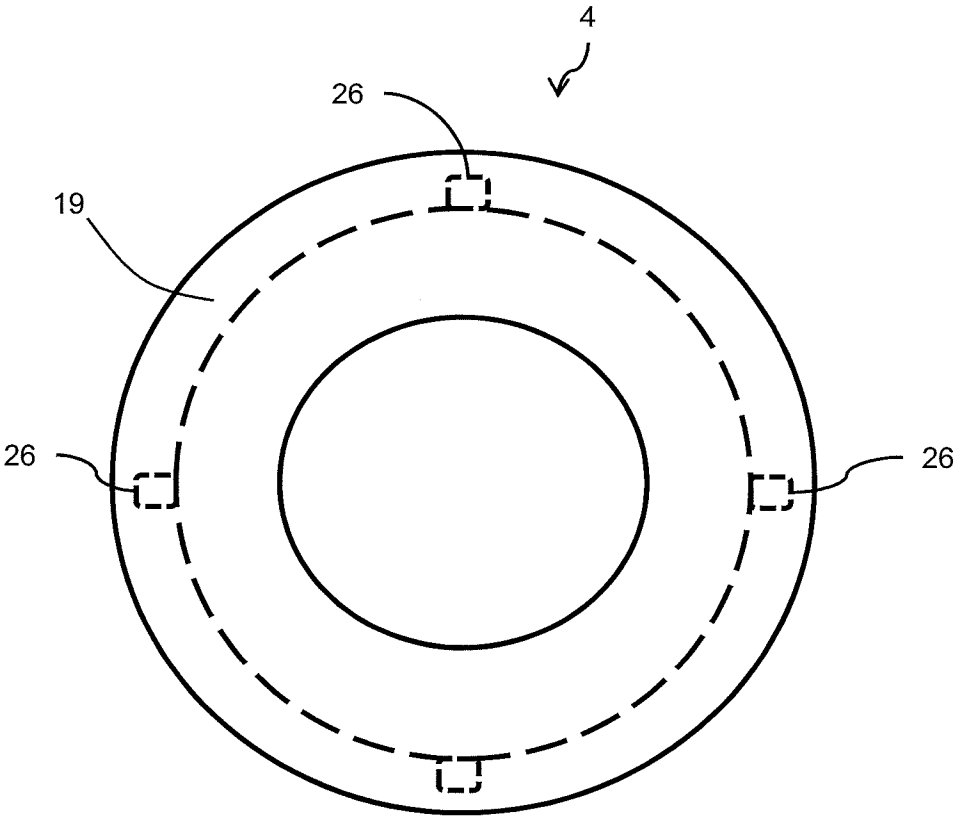
FIG. 1A shows a plan view of the device of FIG. 1.

As shown in FIG. 1A, the device advantageously has stops 26 that have a rounded projecting part placed along the internal wall of the groove 19, with these stops interacting with the second movable end to control and block the movement of the element around the circumference of the opening, by driving in or disengaging the rounded protruding part.

The opening and the closing element 4 can have a circular form or any other form, and by way of example they may have dimensions of the order of 400×400 mm.

Figure 3:
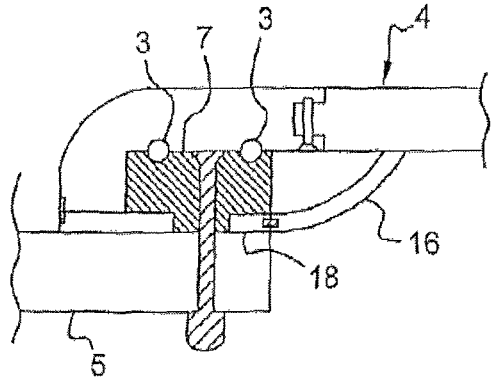
FIG. 3 represents the device pursuant to the disclosed embodiments having a driver that provides for setting the angle of opening of the closing element.

FIG. 3 shows that the device is advantageously provided with a driver 16 that permits setting the angle of opening of the closing element 4. This driver allows for raising or lowering the closing element gradually so as to place the element in an angular position chosen by the user.

This driver has an end fastened to the internal face of the closing element and an opposite end connected to a joining part 18 that is movable in a groove made for this purpose to be able to set the orientation of the element around the opening. This groove is also formed by a non-blocking cavity in the form of a U made in the interior side wall of the protruding part 7.

This driver can be a mechanical, electric, or pneumatic screw jack, which can also be remote-controlled by the user.

This driver can be simply a lever arm, one end of which is mounted in rotation on the joining part. The angular movement of this end can be controlled stepwise by a system of the toothed bar type.

Figure 4:
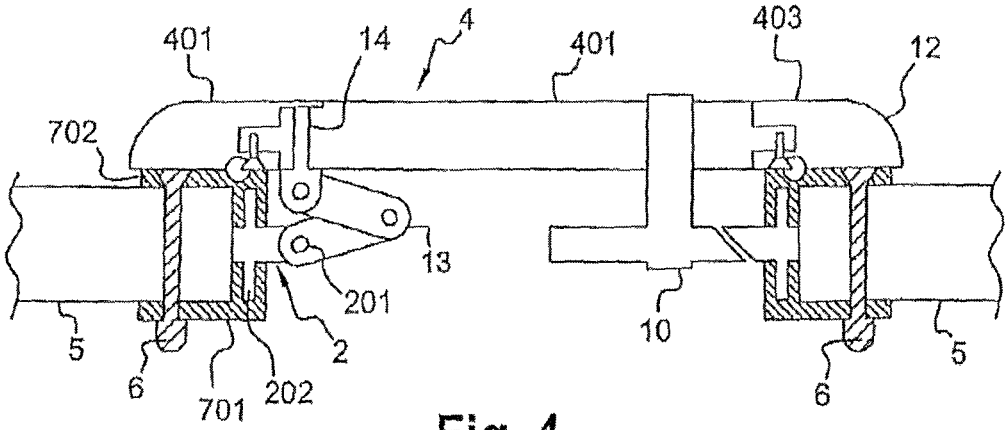
FIG. 4 is a cross sectional view of a device for setting the position of a closing element around an opening according to a second embodiment of the disclosed embodiments, in the position called the rest position.

FIG. 4 shows the device for setting the position of the element 4 according to a second embodiment of the disclosed embodiments in which the protruding part is composed of two protruding sections 701, 702 fastened respectively to the inside and outside surfaces of the wall around the opening, while the groove is formed by the side walls of the two parts and is intended to receive the second movable end 202 of the joining part 2 that is T-shaped. This second embodiment provides reinforcement of the solidity of the frame formed by the two parts 701, 702 on which the element 4 is mounted. Otherwise, in a particular variant, the two protruding parts 701, 702 provide for a more complex assembly in which the element 4 is composed of two transparent parts, one external and one internal, thus permitting double insulation of the part and a tighter seal.

FIG. 4 also shows another possible variant of the disclosed embodiments in which the device has a telescoping arm 13. One end of the arm is fastened to the element 4 by means of at least one fastener 14, and another end is mounted in rotation on the first end 201 of the joining part 2. The second end of the joining part in the form of a T is received by and is movable in the groove provided for this purpose.

Figure 5:
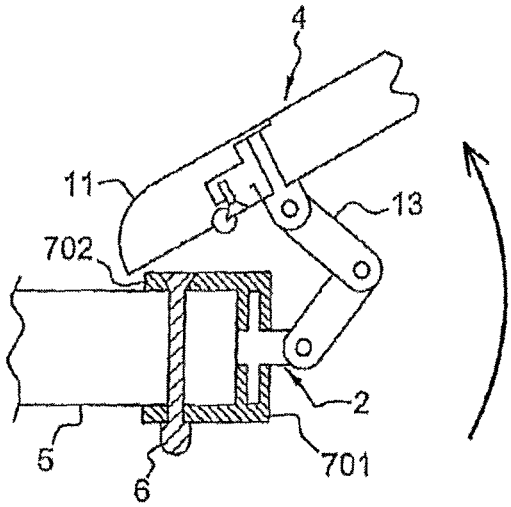
FIG. 5 represents the device of FIG. 4 in the opened position.

This arm is able to move the element 4 from a first position called the rest position in which it covers the opening, to a second position called the use position in which the element 4 is in the open position, forming an inclined surface (FIG. 5). The deployment of the arm can be motorized and remote-controlled. This variant of the device for setting advantageously provides for obtaining a wider range of values of degrees of inclination of the inclined surface formed by the element 4 in the open position.

The invention claimed is:

1. Device for setting the position of a closing element for a porthole in an open position toward an outside around a circular opening in a wall of a room, said device comprising a protruding part with a circular shape fastened to the wall around the opening by at least one fastener, a joining part that has a first end connecting a hinged end of said closing element to the protruding part, wherein said protruding part has at least one first groove, completely encircling said opening, said joining part has a second end movable in said at least one first groove, and the movement of said second end in the at least one first groove entails movement of the closing element around said opening while the closing element is in an open position; and wherein said second end is continuously movable in said groove around the entire circumference of said opening;

when said closing element is in the open position, and wherein said closing element is closable in any position around said opening from the open position.

2. Device according to claim 1, wherein said protruding part is a monobloc part, said at least one first groove being formed by a non-blocking cavity in the form of a U made in a side wall of the protruding part.

3. Device according to claim 1, wherein said protruding part is composed of two protruding parts fastened respectively to the inside and outside surface of the wall around the opening, said groove being formed by the side walls of the two parts and intended to receive the second movable end of the joining part, which is T-shaped.

4. Device according to claim 1, wherein an inside wall of the at least one first groove is covered by a lining made of plastic material.

5. Device according to claim 1, wherein an inside surface of a periphery of the closing element and a facing surface of the protruding part each comprise at least one second groove, in which is inserted a gasket, so that when the closing element is in the closed position, said gasket is compressed between the closing element and the protruding part so as to obtain a seal of the porthole in the closed position.

6. Device according to claim 1, comprising stop elements that have a rounded protruding part placed along an inside wall of said at least one first groove, said stop elements interacting with the second end to control and block the movement of the element in the open position around a circumference of said opening by driving in or disengaging the rounded protruding part in the at least one first groove.

7. Device according to claim 1, wherein the hinged end of the closing element is mounted in rotation on the first end of the joining part, allowing the closing element to be moved from a first position covering the opening, to a second position wherein the closing element is in the open position, forming a surface inclined relative to the wall.

8. Device according to claim 1, comprising a driver intended to set the angle of opening of said closing element, with one end of the driver being fastened to the internal face of the closing element and an opposite end being connected to a joining part movable in a groove formed by a non-blocking groove in the form of a U made in the interior side wall of the protruding part.

9. Device according to claim 1, comprising a gripping element placed on one end of an inside surface of the closing element, said gripping element on the one hand providing for opening the closing element, and on the other hand providing for moving the closing element around the opening.

10. Device according to claim 1, comprising a stepping motor integrated into the joining part, said motor being controlled by a remotely programmable automation system to set an ending position of the closing element around the opening.

11. Porthole mounted on a vertical or horizontal wall, that has a closing element, said porthole being equipped with a device for setting the position of said closing element in the position opened toward the outside around an opening made in the wall according to claim 1.

* * * * *